US009861837B2

(12) United States Patent
Lee

(10) Patent No.: US 9,861,837 B2
(45) Date of Patent: Jan. 9, 2018

(54) LIFT FOR STEALTH CELL TOWERS

(71) Applicant: T-Mobile USA, Inc., Bellevue, WA (US)

(72) Inventor: Joseph B. Lee, Dallas, GA (US)

(73) Assignee: T-Mobile USA, Inc., Bellevue, WA (US)

( * ) Notice: Subject to any disclaimer, the term of this patent is extended or adjusted under 35 U.S.C. 154(b) by 69 days.

(21) Appl. No.: 14/974,384

(22) Filed: Dec. 18, 2015

(65) Prior Publication Data

US 2017/0174482 A1 Jun. 22, 2017

(51) Int. Cl.

| | |
|---|---|
| ***A62B 1/02*** | (2006.01) |
| ***B66D 1/60*** | (2006.01) |
| ***B66B 9/187*** | (2006.01) |
| ***B66D 1/36*** | (2006.01) |
| ***B66D 1/28*** | (2006.01) |
| ***A62B 1/06*** | (2006.01) |

(52) U.S. Cl.
CPC ..... *A62B 1/02* (2013.01); *A62B 1/06* (2013.01); *B66B 9/187* (2013.01); *B66D 1/28* (2013.01); *B66D 1/36* (2013.01); *B66D 1/60* (2013.01)

(58) Field of Classification Search
CPC ..... A62B 1/02; A62B 1/06
See application file for complete search history.

(56) References Cited

U.S. PATENT DOCUMENTS 773,000 A * 10/1904 Canfield ..... E04G 3/34 182/12
3,860,092 A * 1/1975 Holmes ..... A62B 1/02 182/101
4,474,263 A * 10/1984 Christopher ..... A62B 1/02 182/10
4,531,611 A * 7/1985 Curiel ..... A62B 1/02 182/44
4,923,037 A * 5/1990 Stephenson ..... A62B 35/04 188/188
6,343,440 B1 * 2/2002 Ayers ..... H01Q 1/44 52/40
7,616,170 B2 * 11/2009 Renfro ..... H01Q 1/1242 343/890

(Continued)

FOREIGN PATENT DOCUMENTS

DE 10053379 A1 * 5/2002 ..... A62B 1/02

OTHER PUBLICATIONS

Machine translation of DE10053379 A1.*

*Primary Examiner* — Katherine W Mitchell
*Assistant Examiner* — Marcus Menezes
(74) *Attorney, Agent, or Firm* — Lee & Hayes, PLLC

(57) ABSTRACT

Systems and methods for providing lifting workers up cell towers are disclosed. The system is useful on "stealth" cellular towers that do not have external ladders or climbing pegs for aesthetic reasons. The system can include a cable, a system of pulleys, and an internal or external winch. The cable can include a counterweight to enable the cable to be paid out from a storage position at the top of the tower down to the ground under its own weight. Workers can attach a harness or a basket to the cable. The winch can then pull the cable, worker, and/or basket to the top of the tower. The winch can be installed on site or can be provided by an on-site service vehicle. The system can also include a fall arrest system to prevent falls in the event of a component failure.

11 Claims, 11 Drawing Sheets

(56) References Cited

U.S. PATENT DOCUMENTS

| | | | | |
|---|---|---|---|---|
| 9,321,616 | B2 * | 4/2016 | May | B66C 23/62 |
| 2005/0236233 | A1 * | 10/2005 | Boyle | A62B 1/14<br>187/251 |
| 2008/0035425 | A1 * | 2/2008 | Meitus | A62B 1/10<br>182/129 |
| 2009/0267038 | A1 * | 10/2009 | Teichert | B66D 1/38<br>254/335 |
| 2009/0288913 | A1 * | 11/2009 | Nielsen | A62B 1/06<br>182/8 |
| 2014/0069741 | A1 * | 3/2014 | Bergmann | A62B 1/14<br>182/129 |
| 2015/0136525 | A1 * | 5/2015 | May | A62B 1/02<br>182/142 |

* cited by examiner

*To*

LIFT FOR STEALTH CELL TOWERS

BACKGROUND

Cellular data and voice networks are made possible by transmitting data wirelessly using transceivers in a cellular device, such as a cell phone, and transceivers located on tall towers, commonly referred to as, "cell towers." The transmission range for cellular devices and cell towers, however, is limited. The limited range is due to a number of factors including, but not limited to, the available frequency spectrum for cellular communications, transceiver size and power, battery power, and interference from other transmission. In addition, each cell tower has a finite bandwidth capacity.

As a result, cell towers must be placed throughout the coverage area to ensure that a user is always, or almost always, within range of a cell tower. In addition, the number of cell towers should be such that each cell tower has sufficient bandwidth to support the number and type of users in the area. Unfortunately, cell towers can be somewhat less than aesthetically pleasing. Thus, cell towers may be frowned upon in urban areas due to the number of people that see them and space constraints, among other things.

To this end, "stealth" cell towers have been invented that mimic trees, church steeples, and other structures. In this manner, cell towers can be installed, yet remain largely unnoticed. A cell tower disguised as a pine tree and installed in a stand of pine trees, for example, may be all but invisible to the casual observer.

To access the top of cell towers—for maintenance and repairs, for example—cell towers generally have climbing pegs, ladders, or other means for workers to manually climb the tower. Unfortunately, to remain stealthy, it is preferable that stealth cell towers do not have this feature because pine trees, for example, do not generally have climbing pegs. To access the top of a stealth cell tower, therefore, maintenance crews are generally required to bring in a cherry picker or crane to access the top of the cell tower.

Indeed, some cell towers can be 250 feet tall, or more. In addition, cell towers can be installed in inaccessible locations or in mountainous terrain. The cost to rent a crane that is large enough to reach these heights is considerable.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Examples of the present disclosure can comprise a system for lifting a worker to the top of a cell tower. The system can include a cable and a series of pulleys installed on the cell tower. The system can also include a counterweight to enable the cable to be lowered to the ground from a stowed position to a deployed position. Once in the deployed position, the worker can connect to the cable using a harness, for example, or a platform. A winch system can then pull the cable—and the worker—from the ground to the top of the cell tower for maintenance or repairs on the cell tower.

A majority of the functional components of a cell tower are located at the top. A cell tower can comprise, for example, multiple antennas, transceivers, digital switches, and a beacon. Many of these components are "wear" items. Bulbs burn out in beacons and switches fail over time. Many of these components are inexpensive to purchase and easy to replace once the worker is on top of the cell tower.

Cell towers are generally between 100 and 250 feet tall. As mentioned above, "stealth" cell towers, or towers that are disguised as something else, often do not have ladders, climbing pegs, or other means for workers to manually climb to the top. This is obviously so that the tower looks more like what it is intended to look like (e.g., a pine tree), but can also be due to local ordinances or covenants. As a result, many of these towers can only be accessed with a crane.

In addition, cell towers can be installed in remote areas or surrounded by trees or hilly or uneven terrain. This can increase the size and cost of the crane required significantly, for example, by requiring that the crane park in an adjacent location (e.g., a parking lot) and reach over to the tower. In addition, due to travel and setup time, cranes often have minimum charges (e.g., a minimum of 4 hours at $1000/hour) regardless of how long they are actually used. Thus, while a new bulb for a beacon or a new digital switch may be less than $100 and take five minutes to replace, the crane rental required to replace it can cost $3,000, $10,000, or more.

It would be advantageous, therefore, to provide a man lift system that is self-contained in, or on, the cell tower itself. The system should be simple, safe, robust, and relatively inexpensive. It is to such a system that examples of the present disclosure are primarily directed.

Figure 1:
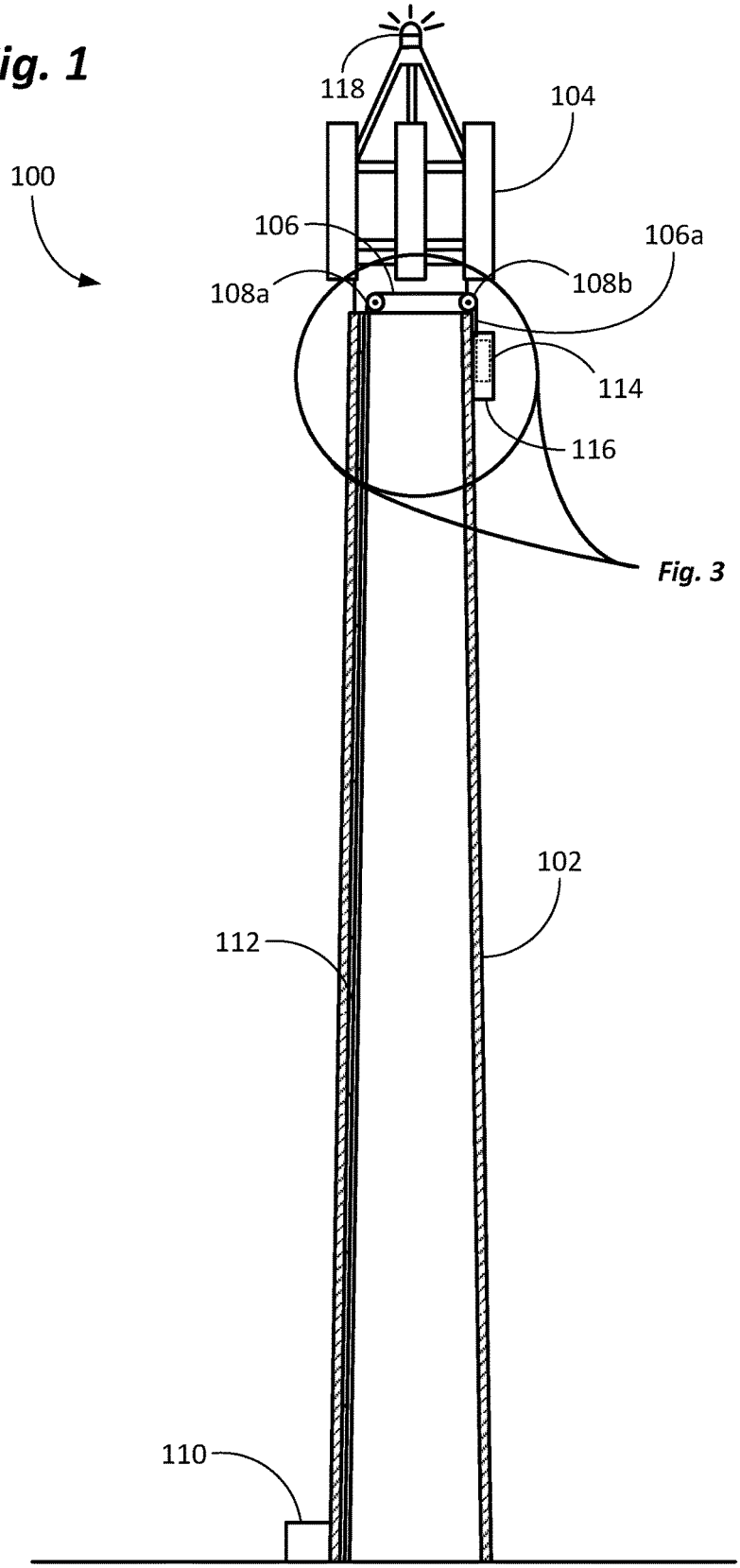
FIG. 1 is a cross-sectional view of a cell tower with a self-contained man lift in the retracted position, in accordance with some examples of the present disclosure.

Examples of the present disclosure comprise a system 100 for lifting a worker to the top of a cell tower, antenna, or other tall structure. FIG. 1 depicts a typical cell tower 102—i.e., without "stealth" features—for clarity. The system is equally applicable to either type of cell tower or, indeed, other types of towers and tall structures, but is particularly useful for stealth towers that often do not have climbing pegs or ladders, for example.

The tower 102 can include a plurality of antennas 104, and other electronic equipment mounted at the top of the tower 102 that needs periodic service. To facilitate this service, therefore, the system 100 can also include a cable 106, and one or more pulleys 108. In some examples, a portion of the system 100 can be at ground level, outside the tower and thus, can be stored in a locker 110. In some examples, the system 100 can also comprise a conduit 112 within which a portion of the cable 106 can travel.

Figure 2:
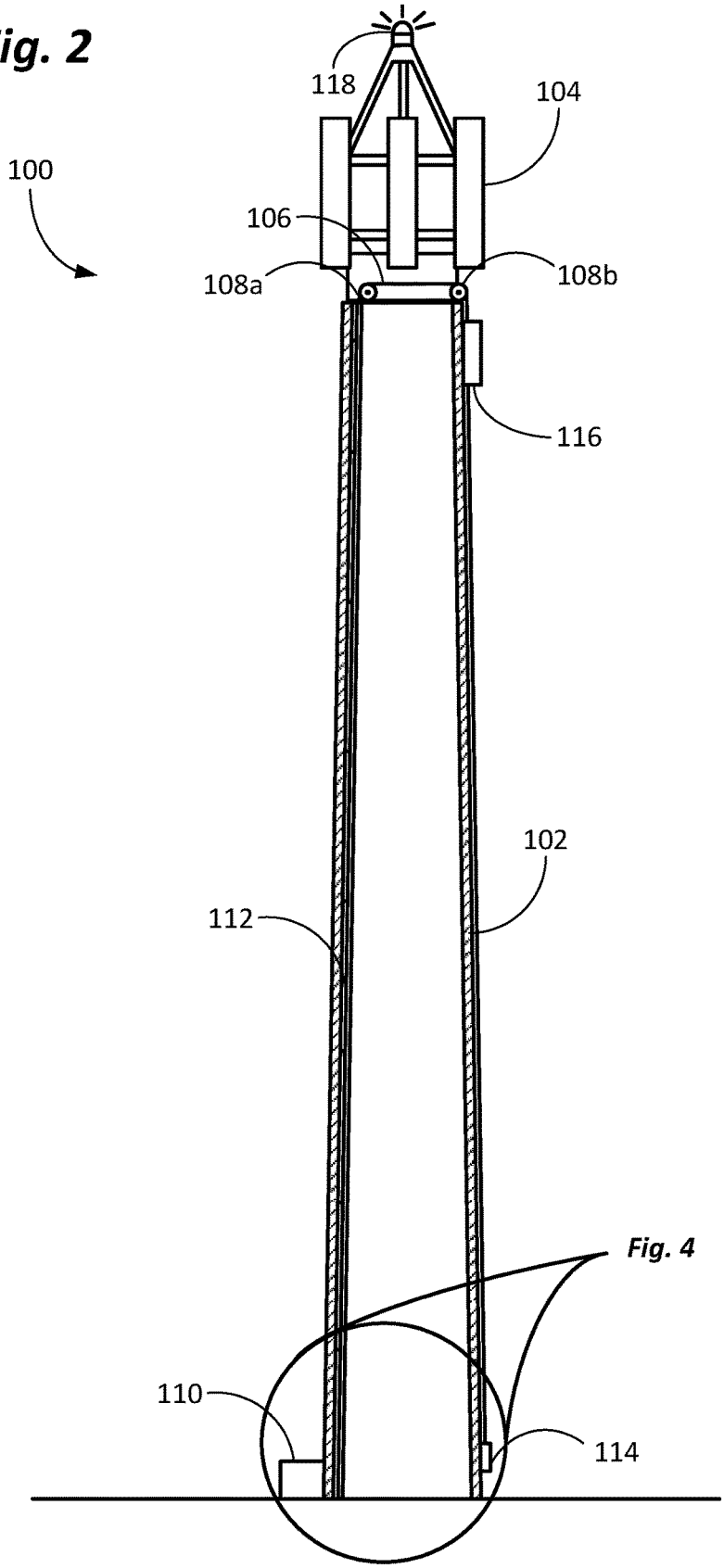
FIG. 2 is a cross-sectional view of the cell tower with the self-contained man lift in the deployed position, in accordance with some examples of the present disclosure.

The cable 106 can have a retracted position and a deployed position. In the retracted position (FIG. 1), the first end 106*a* of the cable 106 can be proximate the top of the tower 102. The cable 106 can be in this position for storage when the system 100 is not in use, or when a worker has been lifted by the system 100 to the top of the tower 102. The cable 106 can also have a deployed position (FIG. 2), in which the first end 106*a* of the cable is at, or near, ground level. This can enable a worker to hook a harness or platform, as applicable, to the cable 106 for lifting. The cable 106 can comprise a suitably strong and flexible material such as, for example, nylon, polyester, or Spydura® rope. In a preferred embodiment, the cable 106 can comprise stainless steel or galvanized aircraft cable.

In some examples, to facilitate the deployment of the cable 106, the cable can also comprise a counterweight 114. As discussed below, the weight of the counterweight can be calculated based on the height of the tower and thus, the weight of the cable 106. The counterweight 114 can enable the cable 106 to be deployed by gravity, rather than having to push or pull the cable 106 down the tower 102. In some examples, in the retracted position, the counterweight 114 can be pulled into a retainer 116. The retainer 116 can prevent the counterweight from swinging around when not in use and damaging the tower 102 or other equipment. In some examples, the tower 102 can also comprise a beacon 118 to alert local air traffic of the location of the tower 102.

Figure 3:
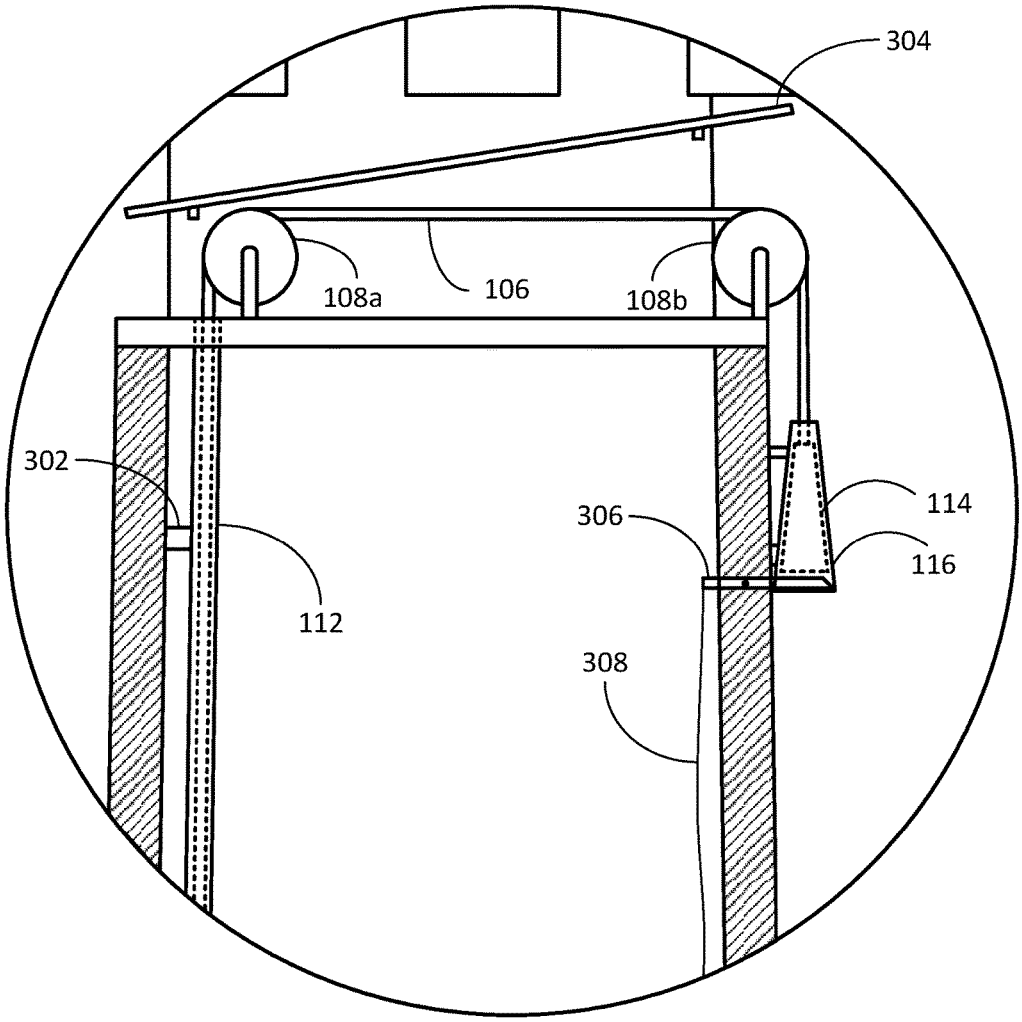
FIG. 3 is a detailed view of a top portion of the self-contained man lift, in accordance with some examples of the present disclosure.

FIG. 3 depicts a detailed view of the top portion of the system 100. Cell towers generally contain a plurality of wires and cables inside the tower 102. This can include, for example, coaxial, fiber optic, Ethernet, and power wires. It is possible, if left uncontrolled, therefore, that the cable 106 for the system 100 could damage the cables inside the tower 102. To this end, in some examples, the cable 106 can travel inside a conduit 112. The conduit 112 can be mounted on the inside or outside of the tower 102 with a plurality of mounts 302. The mounts 302 can comprise, for example, brackets, I-bolts, or clamps to affix the conduit 112 to the tower 102. It is preferably that the conduit 112 be substantially straight to prevent excessive wear from the cable 106 rubbing on the inside of the conduit 112 during use. In some examples, it may be preferable to mount the conduit 112 on the inside of the tower 102 to provide protection from the elements, among other things. In other examples, it may be preferable to mount the conduit 112 on the outside of the tower to facilitate installation, for example.

Of course, because the cable 106 can be fairly flexible, perfect alignment is not required. Indeed, substantial bends could be introduced into the conduit 112 to, for example, avoid existing structures or components in the tower 102. In this case, the conduit 112 can comprise wear pads, for example, in locations where the cable 106 contacts the conduit 112. The wear pads can be sufficiently hard that they are not significantly affected by the cable 106 or could be replaceable (i.e., "sacrificial"). The conduit 112 can comprise, for example, square or round pipe. The conduit 112 can comprise steel, aluminum, iron, or PVC, among other things.

The system 100 can also comprise a plurality of pulleys 108 located at the top of the tower 102 to guide the cable 106. In some examples, a first pulley 108*a* can be disposed proximate the end of the conduit 112 at the top of the tower 102. A second pulley 108*b* can be disposed at the top of the tower 102, opposite the first pulley 108*a*. In this manner, the cable 106 can travel substantially vertically up the inside of the tower 102, inside the conduit 112, turn through 90 degrees on the first pulley 108*a*, travel across the tower to the second pulley 108*b*, and turn another 90 degrees to travel back down the outside of the tower 102.

Of course, in some examples, a single pulley 108*a* can be used. In other words, in some examples, the cable 106 can travel vertically up the inside of the tower 102 inside the conduit 112, turn 180 degrees over the first pulley 108*a*, and then travel back down the outside of the tower. The single pulley configuration can be achieved using a cable that is sufficiently flexible and resilient to be turned 180 degrees in a relatively small radius, for example, or a sufficiently large pulley 108*a*.

As shown, the cable 106 can also include a counterweight 114. The counterweight 114 can enable the cable 106 to be deployed using gravity to pull the cable 106 to the bottom of the tower. In some examples, the counterweight 114 can be stored in a retainer 116. The retainer 116 can be attached to the tower 102 and can substantially prevent the counterweight 114 from moving when not in use. In some examples, both the counterweight 114 and the retainer 116 can have a complementary shape so that the counterweight 114 fits snugly in the retainer 116. In some examples, as shown, both the counterweight 114 and the retainer 116 can be tapered such that, when the counterweight 114 is pulled into the retainer 116, the complementary shapes substantially center and steady the counterweight 114.

In some examples, the retainer 116 can include a safety catch 306. The safety catch 306 can retain the counterweight 114 in the retainer 116 when not in use. In some examples, the safety catch 306 can be a simple mechanical catch. In this configuration a small cable 308 can lead to ground level to enable the safety catch 306 to be released prior to use. In other examples, the safety catch 306 can comprise, for example, a solenoid, linear actuator, or other electronic device to enable the safety catch 306 to be operated from ground level. In some examples, the safety catch 306 can include a wire leading to a switch at ground level. In other cases, the safety catch 306 can comprise a remote control receiver operated by a hand-help remote control (e.g., similar to vehicle keyless entry systems).

The tops of cell towers are often not enclosed, relying instead on the electronics, cables, and other equipment being weather resistant. Birds often use cell towers as both perches and nesting areas. As a result, in addition to weather, the towers can be subjected a considerable quantity of droppings. To this end, in some examples, the system 100 can also include a partially or fully enclosed roof 304. The roof 304 can protect the pulleys 108*a*, 108*b* and cable 106 when not in use and can prevent debris and rain, for example, from entering the conduit 112.

Figure 4:
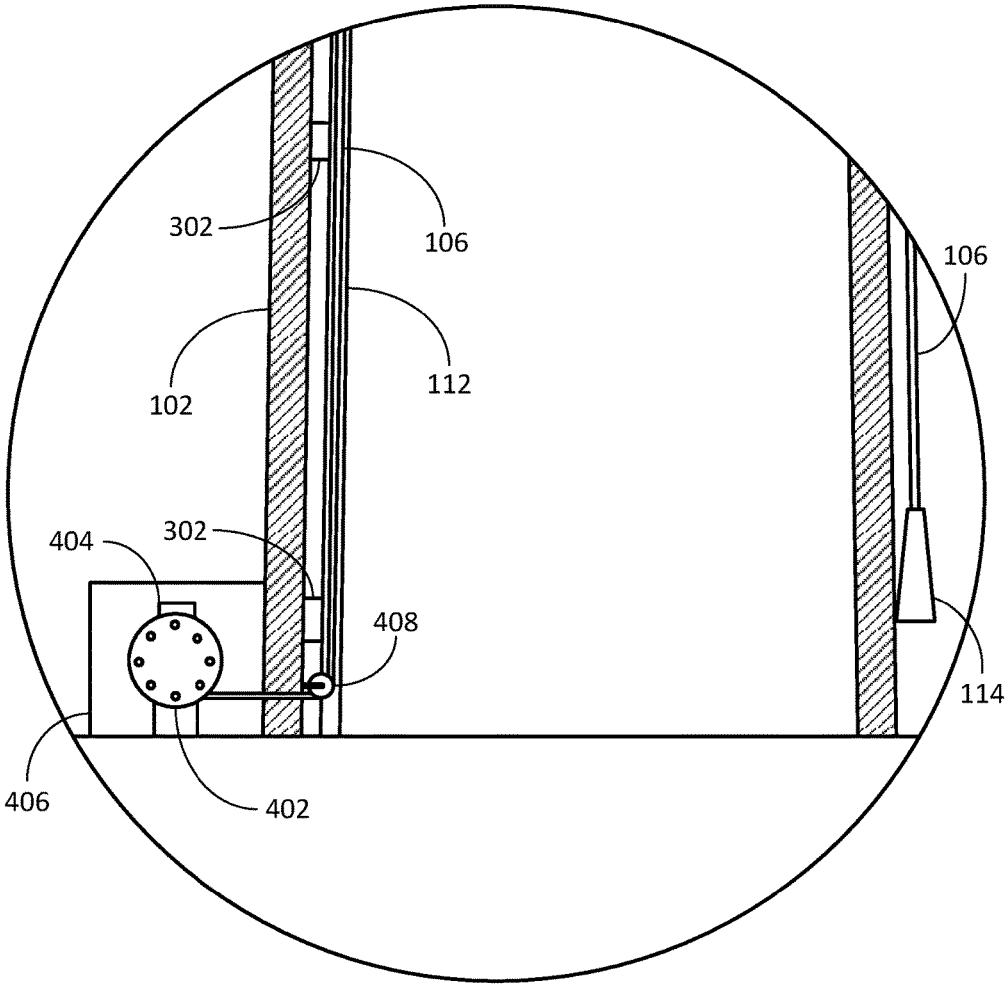
FIG. 4 is a detailed view of a bottom view of the self-contained man lift, in accordance with some examples of the present disclosure.

As shown in FIG. 4, in some examples, the system 100 can also include a winch 402. The winch 402 can comprise, for example, an electric, hydraulic, or pneumatic winch for paying out and retracting the cable 106 and for lifting a worker up the tower 102. As such, the winch 402 can have a sufficient power rating to pull the cable 106 and a worker without overheating or failing. In some examples, the winch 402 can have power in excess of what is required to provide a safety margin.

The winch 402 can also include a brake 404. In some examples, the brake 404 can use the winch 402 motor. In other words, the winch 402 motor can include electronics to make the motor provide an opposing force to the cable 106 being paid out. This can be achieved, for example, by reversing the polarity of the motor (if electric) or reversing the flow of fluid to the motor (if hydraulic or pneumatic).

In other examples, the winch 402 can include a physical brake 404. In this configuration, the brake 404 can act on the drum of the winch 402 or directly on the cable 106. In some examples, the brake 404 can comprise a caliper, for example, that acts directly on a flange on the drum of the winch 402. In other examples, the brake 404 can comprise a clamp, or other means, that applies friction directly on the cable 106. The brake 404 can enable the descent of a worker from the top of the tower 102 to be slowed or stopped. In some examples, the brake 404 can also hold the cable 106 in the retracted position when not in use.

The winch 402 can also comprise a "free-spool" release or clutch. In this manner, cable can be paid out by simply releasing the free-spool release and allowing the counterweight to fall to the ground. The free-spool release can then be reengaged to reconnect the spool on the winch to the motor.

The system 100 can also comprise a cover, or "doghouse" 406. The doghouse 406 can comprise a shed or roof designed to enclose the winch 402. The doghouse 406 can protect the winch 402 from the elements and can prevent tampering with the system 100 by unauthorized people. In some examples, the doghouse 406 can also house other electronics associated with the tower 102. If necessary, the doghouse 406 can also be climate controlled.

The system 100 can also include a bottom pulley 408. The bottom pulley 408 can enable the cable 106 to be routed from the spool of the winch 402 and then turned 90 degrees into the conduit 112. In other examples, the winch 402 can be placed such that the cable 106 feeds off the spool of the winch 402 and directly into the conduit 112 obviating the needs for the bottom pulley 408.

Periodic inspection of the cable 106 may be desired to ensure safety and smooth operation. The cable 106 may develop frays or kinks, for example, that left unchecked might cause the cable 106 to fail. It may be desirable, however, to inspect the cable 106 without having to remove it from the system 100. In some examples, therefore, the cable 106 can be selected based on the height of the tower 102. In other words, one way to be able to inspect the entire cable is to size the cable 106 such that it is three times the height of the tower 102. In this manner, in the fully retracted position, ⅔ of the cable 106 is available for inspection on the winch 402. In the fully deployed position, on the other hand, ⅔ of the cable 106 is outside the tower 102 for inspection. In this manner, the entire length of the cable can be inspected from the ground.

Figure 5A:
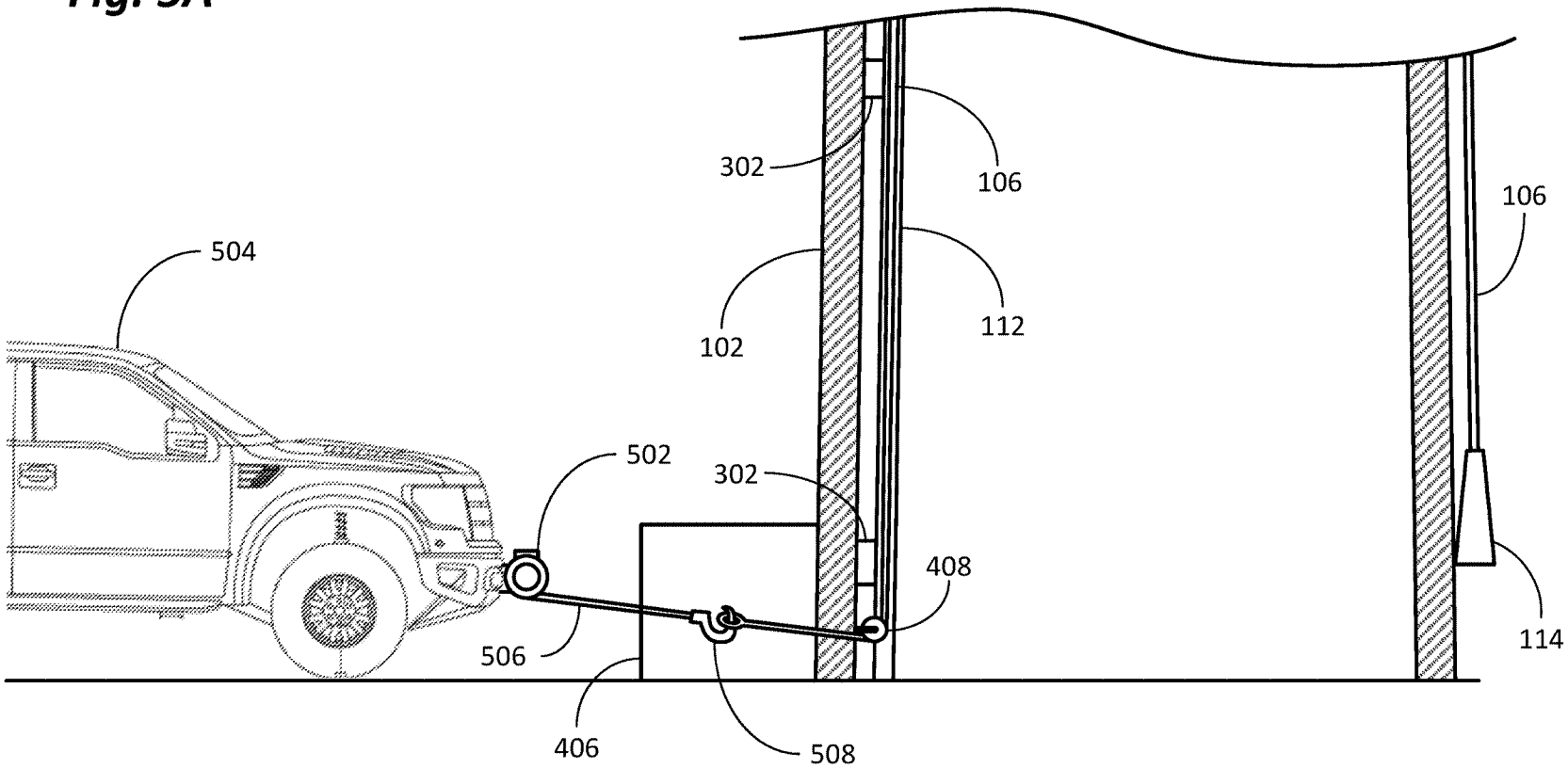
FIG. 5A is a detailed view of an example of the man lift that utilizes a winch from a service vehicle, in accordance with some examples of the present disclosure.

As shown in FIG. 5A, in some examples, rather than having a dedicated winch 402, the system 100 can utilize a vehicle-mounted winch 502, or the vehicle itself 504. In other words, many vehicles, and particularly service vehicles, have vehicle-mounted winches 502. Vehicle-mounted winches 502 can be used for self-recovery, for example, or to pull other equipment. In this configuration, the winch cable 506 from the vehicle-mounted winch 502 can be attached to the cable 106 and can provide the motive force for the system 100. In other examples, the system 100 can use the vehicle 504 to provide the motive force. In other words, the worker can simple attach the cable 106 to the vehicle 504 and move the vehicle 504 under its own power to pull the cable 106. In either configuration, a back-up braking system can be provided in case the cable 106 becomes detached from the vehicle 504. The vehicle 504 can be connected to the cable 106 by using an appropriate device such as, for example, a tow hook 508, carabiner, or tow strap.

Figure 5B:
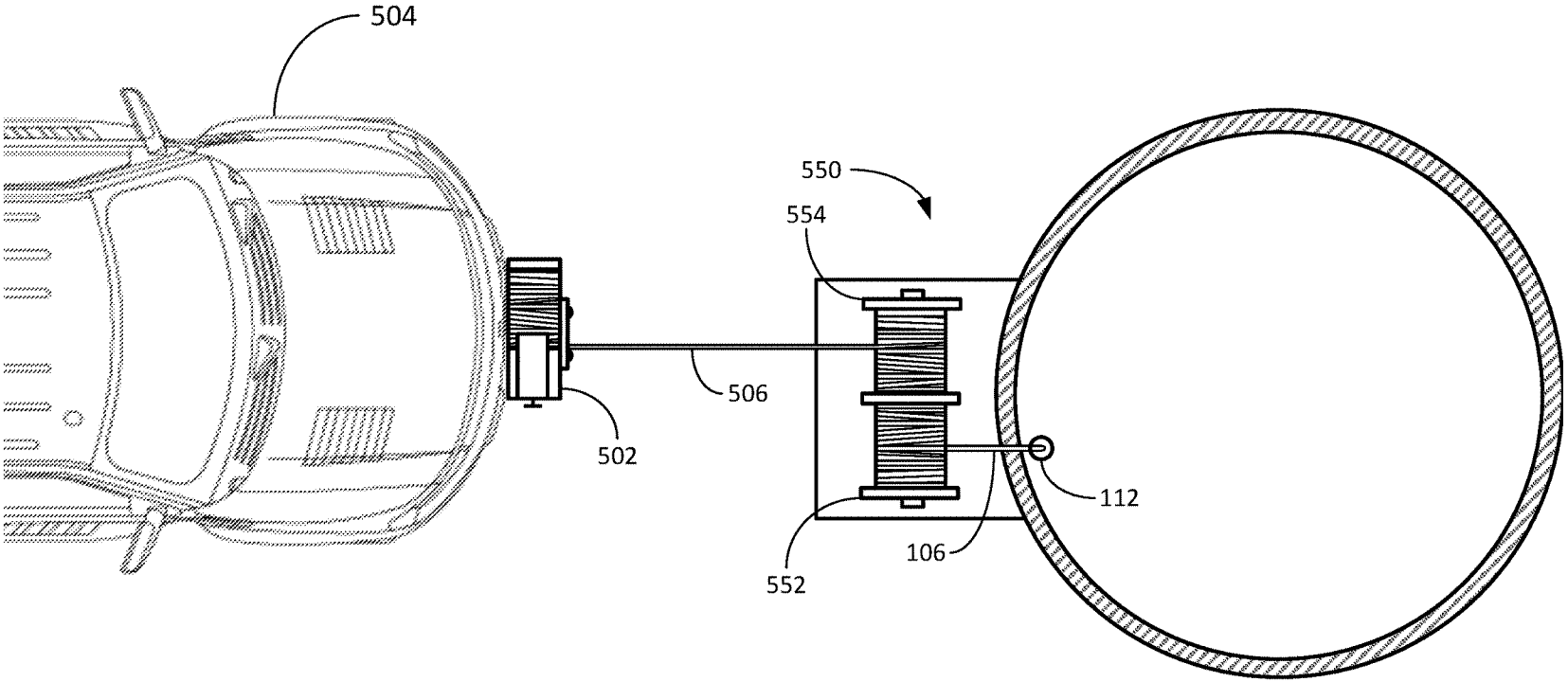
FIG. 5B is a detailed view of an example of the man lift that utilizes a dual-spool system and a winch from a service vehicle, in accordance with some examples of the present disclosure.

As shown in FIG. 5B, in some examples, rather than having a dedicated winch 402, the system 100 can utilize a dual-spool system 550. In this configuration, the cable 106 can be attached to a first spool 552 and the winch cable 506 from the vehicle-mounted winch 502 can be attached to a second spool 554. The first spool 552 and the second spool 554 can be connected such that, when the vehicle-mounted winch 502 rotates the second spool 554, the first spool 552 also rotates. The cable 102 and the winch cable 506 can be wound in opposite directions, however, such that unspooling the cable 106 off the first spool 552 spools the winch cable 506 onto the second spool 554. In this manner, the winch cable 506 from the vehicle-mounted winch 502 can be paid out as the cable 102 is moved from the retracted position to the deployed position without fear of the winch cable 506 or the hook 508 entering and possibly jamming in the conduit 112 or other system components.

In use, when the cable 106 is in the retracted position (i.e., the counterweight 114 is at the top of the tower 102), a portion of the cable 106 can be wound around the first spool 552. Prior to lowering the counterweight 114, the worker can attach the winch cable 506 from the vehicle-mounted winch 502 to the second spool 554. The counterweight 114 can then be lowered, unwinding the cable 102 from the first spool 552, but winding the winch cable 506 onto the second spool 554. To raise the worker (or the counterweight 114) back to the top of the tower 102, the vehicle-mounted winch 502 can be operated to wind the winch cable 506 back onto the spool of the vehicle-mounted winch 502 and thus, wind the cable 102 back onto the first spool 552. In this configuration, when the counterweight 114 is secured in the retracted position, the winch cable 506 has also been removed from the second spool 554. Thus, the winch cable 506 (and the vehicle 504) can be disconnected from the system 550.

Figure 6:
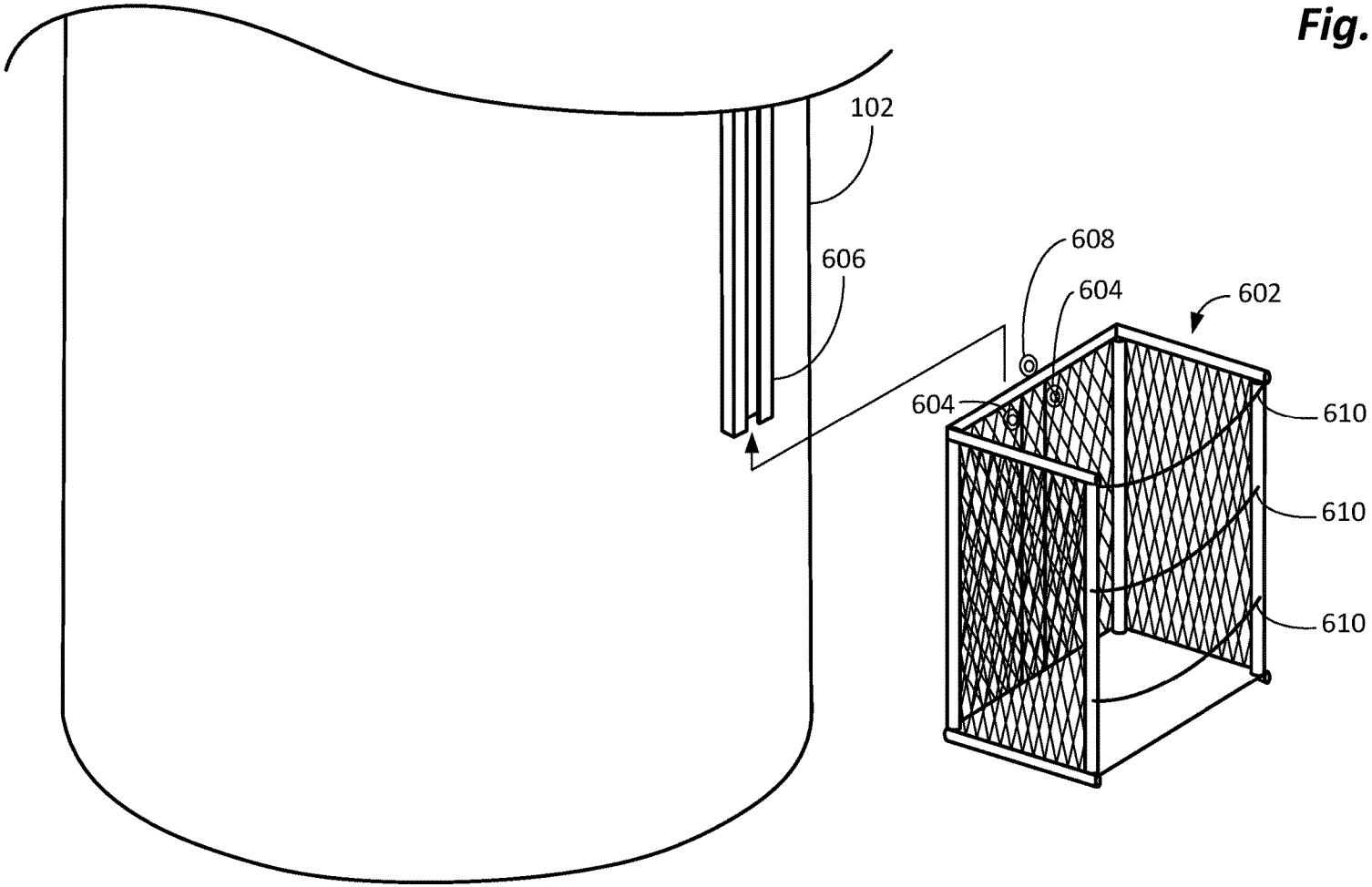
FIG. 6 is a perspective view of a basket and channel for use with the man lift, in accordance with some examples of the present disclosure.

In some examples, the worker can use a harness and clip into the cable 106 to be lifted up the tower. As shown in FIG. 6, however, in some examples, it may be desirable to have a basket 602 from which workers can perform their duties. In this configuration, the cable 106 can be attached to the basket 602 to pull the basket up the tower 102. In some examples, the basket 602 can have rollers 604 to enable the basket 602 to roll where it contacts the tower 102. In some examples, the rollers 604 can be disposed in an array with a similar radius as the tower 102. In this manner, the rollers 604 can also serve to stabilize the basket 602 somewhat.

In other examples, the tower 102 can include a rail or channel 606. The channel 606 can comprise an I-beam, for example, or a C-channel (shown) to provide a guideway for the basket 602. In some examples, the rollers 604 can ride inside the C-channel 606 to guide the basket 602 on the tower 102. In other examples, the channel 606 can comprise an I-beam, for example, with the rollers 604 riding on the outside of the channel 606. In some examples, the rollers 604 can be spring-loaded (either inwardly or outwardly depending on the configuration) to provide some tension between the rollers and the channel 606. Of course, while described herein as "rollers," the rollers 604 can also comprise plastic shoes, leaf springs, or other means configured to ride inside the C-channel (or outside the I-beam) to maintain the alignment of the basket 602.

The basket 602 can include a mounting point 608 to enable the cable 106 to be attached to the basket 602. The cable 106 can be affixed to the basket 602 using, for example, a carabiner, a snap ring, or bolts. In some examples, the basket 602 can also comprise one or more safety chains 610. The basket 602 may be required safety equipment in some areas, for example, or may be required by the Occupational Safety and Health Administration (OSHA).

In some examples, the rollers 604 can also act as an emergency braking device. In other words, in some examples, the rollers 604 can provide sufficient resistance to rolling such that the basket cannot exceed a predetermined speed (e.g., 3 mph). This can be achieved using specifically designed bearing, for example, or by using bearing grease of sufficient viscosity to prevent the rollers 604 from turning above the predetermined speed.

In other examples, the basket 602 can include a separate braking system that activates automatically. The braking system can be tied to the tension of the cable 106. In other words, the mounting point 608 can be attached to a spring-loaded lever such that when tension is applied to the cable 106 by the winch 402 or the weight of the basket 602, for example, the lever moves from a locked position to a free position, extending the spring, and the braking system releases. If the basket 602 is on the ground or the cable breaks, on the other hand, and no tension is applied to the lever, the spring can automatically move the lever back to the locked position and the braking system can stop or slow the basket 602. In some examples, the braking system can comprise a brake caliper, or other means, acting on the channel 606 to slow or stop the basket.

Figures 7A, 7B:
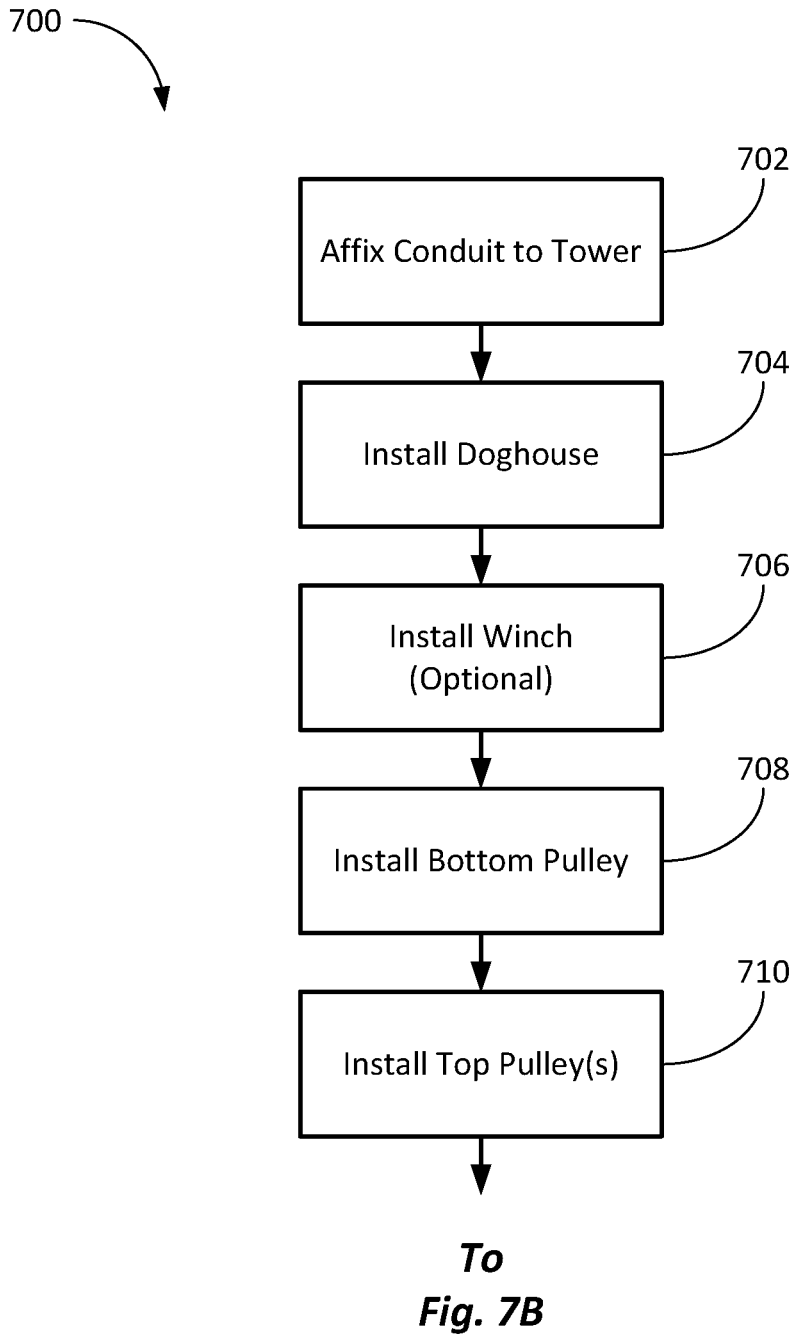
FIGS. 7A and 7B depict a method for installing the man lift on a cell tower, in accordance with some examples of the present disclosure.
Figure 7B:
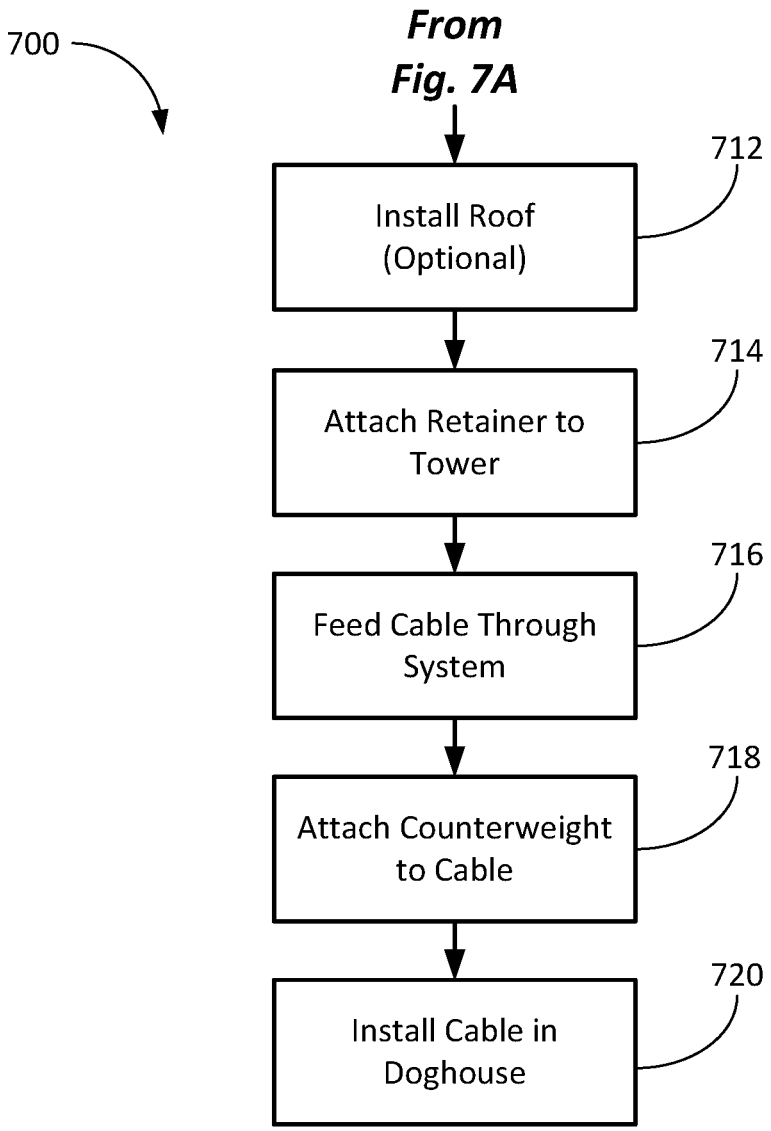
Figure 8A:
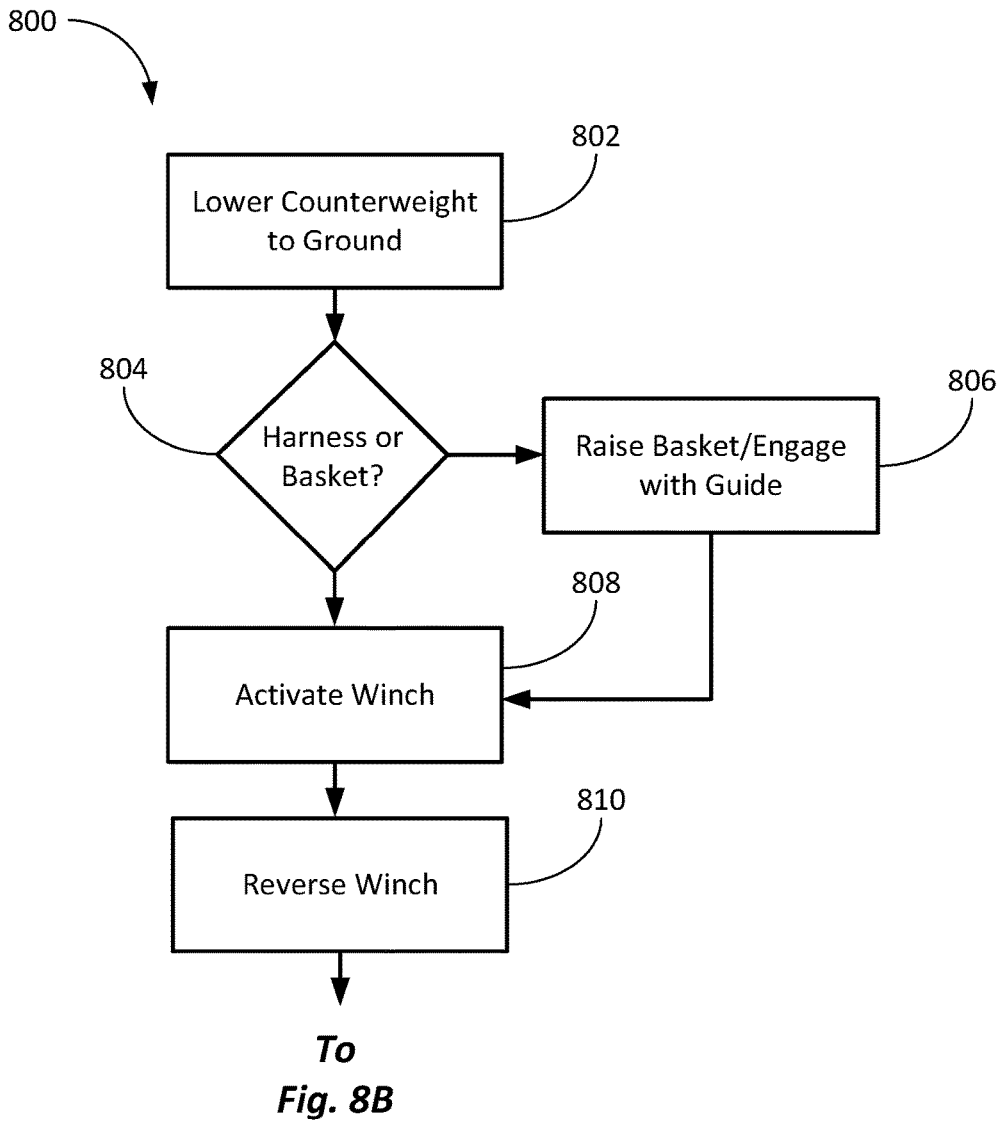
FIGS. 8A and 8B depict a method for using the man lift to access the top of a cell tower, in accordance with some examples of the present disclosure.
Figure 8B:
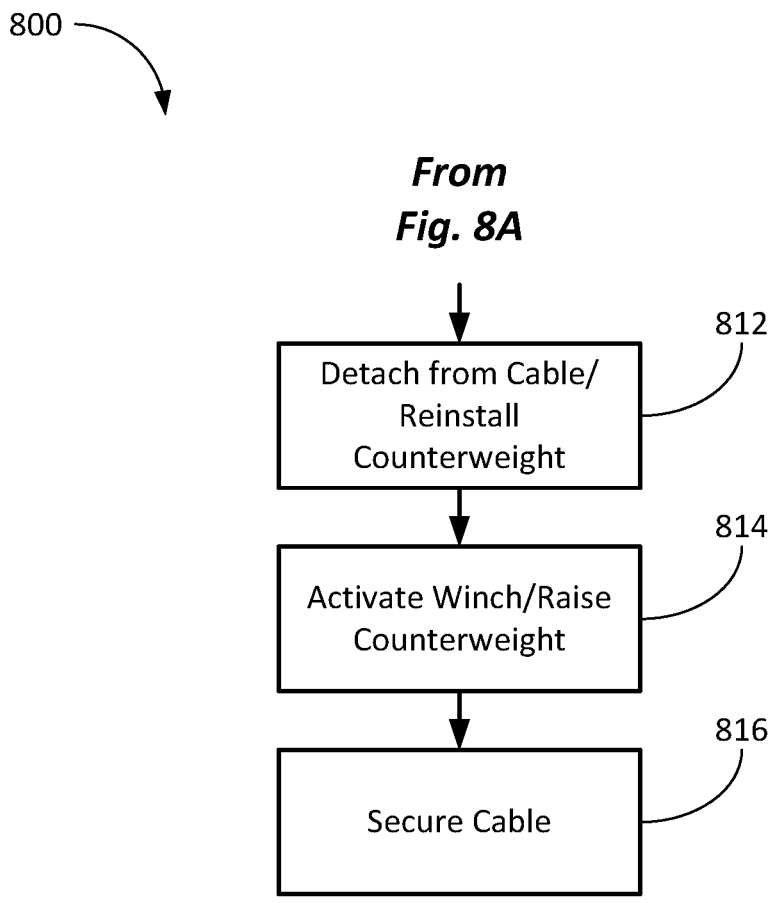

As shown in FIGS. 7A and 7B, examples of the present disclosure can also comprise a method 700 for installing the system 100. Installation can be performed when the tower is being manufactured or when it is already in service. At 702, the method can begin with affixing the conduit to the tower. As mentioned above, the conduit is preferably straight and plumb to minimize the contact between the cable and the conduit. In some examples, the conduit can be welded to the inside or outside surface of the tower. In other examples, the conduit can be attached to the tower using a series of brackets. The brackets can be adjustable for length to enable the conduit to be mounted substantially plumb. The brackets can also be adjusted to account for any taper in the tower (i.e., cell towers generally have tapered poles, not cylindrical poles).

At 704, the doghouse can be attached to the base of the tower. The doghouse can provide a weather- and tamper-proof enclosure for the winch and other equipment. The doghouse can also include a door or access panel to enable workers to access the winch controls and/or the cable during use. The doghouse can be mounted on the ground at the foot of the tower (e.g., on a concrete pad) or can be mounted to the tower slightly above the ground.

At 706, optionally, the winch can be installed in the doghouse. The winch can be bolted to the concrete slap, for example, or directly to the tower. The winch can include a suitably sized reel for the amount of cable required for the tower (2-3 times the height of the tower). In some examples, the winch can be connected to the line power of the tower or to a dedicated electrical connection. In other examples, the winch can be battery powered or use power from a vehicle (e.g., electrical power or a power take-off (PTO) from a service vehicle) and thus, not require electrical connections. As mentioned above, in some cases, the motor of the winch can provide the necessary braking for the system 100. In some configurations, a separate braking system can be installed to replace or supplement the braking force provided by the winch. As discussed above, in some cases, a vehicle-mounted winch can be used obviating this step.

At 708, the bottom pulley can be installed on the bottom of the tower. At 710, the top pulley, or pulleys, can be installed at the top of the tower. For towers already in use, a crane will likely be required to complete this portion of the install. At 712, optionally, the roof can be installed on the top of the tower over the top pulley(s). The roof can be attached to the top of the cell tower, the antenna rack, or other suitable space.

At 714, the retainer can be attached to the top of the tower. In some examples, the retainer can simply be a cover attached directly to the tower. In other examples, the retainer can be a separate housing that is attached to the tower using brackets. The retainer can include a hole through which the cable can be fed.

At 716, the cable can be fed through the retainer, over the top pulleys, down the conduit, over the bottom pulley and around the winch (if applicable). Of course, the order of installation of the cable is somewhat immaterial and could be done in reverse order if that is more convenient. At 718, the counterweight can be installed on one end of the pulley. The counterweight can enable the cable to be deployed without using the winch. In some cases, the worker can simply release the brake—either on the winch or elsewhere—and the counterweight can fall to the ground bringing the cable with it. In some examples, the worker can use the brake to control the speed of travel of the cable as necessary to prevent injuries or damage from the falling counterweight.

At 720, the cable can be installed in the dog house. For a winch configuration, the cable can be wound onto the drum of the winch and the counterweight can be lifted until seated in the retainer at the top of the tower. In the non-winch configuration, the end of the cable can simply be stored in the doghouse to enable later connection to an external winch.

Examples of the present disclosure can also comprise a method 800 of using the system. As discussed above, the method 800 can utilize either a harness or a basket to lift the worker up the tower. This can enable the tower to be maintained (e.g., painted) and can also enable components, such as antennas and electronics, to be replaced. On stealth towers, this may also include replacing branches or other disguising features.

At 802, the worker can pay out enough cable to lower the counterweight to ground level. In some examples, this can involve running the winch (either a built-in winch or a vehicle-mounted winch) in reverse until the counterweight reaches ground level. In other examples, the drive on the winch can be disconnected and the cable can simply be allowed to pay out due to the counterweight. In still other examples, an external brake or clamp can be used to regulate the speed of the descent of the counterweight. In some examples, once on the ground, the counterweight can be removed to expose the attachment point for use by the worker. In other examples, the counterweight can be permanently installed on the cable and can be used as an attachment point.

At 804, the worker can determine whether to use a harness or a basket. This decision may be based on whether the tower has a channel installed for the basket, for example, weather conditions, or regulations (e.g., OSHA). At 806, if using a safety harness, the worker can attach to the cable using a suitable fastener. In some cases, a locking carabiner or snap ring can be used. The safety harness can comprise a standard climbing or safety harness comprising one or more straps and fasteners suitable to support the worker's weight when suspended by the cable 106. At 804, if the basket is being used, the worker can attach the cable to the basket using similar means.

At 806, the winch can be activated to raise the basket until the basket engages the channel on the tower or contacts the tower, as applicable. In some examples, the winch can be operated by a second worker to enable the worker to guide the basket into the channel. In other examples, the winch can be operated by a wired or wireless remote control by one of the workers. The use of a remote control can obviate the second worker reducing costs. A second worker may nonetheless be required by company or government safety standards.

At 808, the winch can be activated in earnest to lift the worker (by his harness or in the basket) up the tower. In some cases, the worker may perform maintenance on the tower itself as he ascends. In other examples, the worker may need to replace components at the top of the tower (e.g., antennas, switches, and other equipment). At 810, once repairs have been completed, the worker can reverse the winch lowering himself and/or the basket back to the ground.

At 812, the worker can detach the cable from the harness or basket and reinstall the counterweight, if applicable. At 814, the worker can activate the winch to lift the counterweight back to the top of the tower until it seats in the retainer. As mentioned above, the retainer can substantially prevent the cable and counterweight from moving when stored due to wind, birds, or other factors. At 816, the cable can then be locked into place. In some examples, this can be done by using a locking mechanism on the winch. In other examples, a separate locking mechanism can be used to lock the cable to the bottom of the tower for storage. The doghouse can be locked, if necessary, to prevent tampering by humans, for example, or nesting by animals.

The system described herein can enable workers to service cell towers that are otherwise inaccessible. Stealth cell towers, for example, disguised as trees or other objects, do not have ladders or climbing pegs to further hide their true purpose. The system described herein enables workers to lift themselves to the top of the tower without having to pay for expensive cranes. The system uses a winch and a system of pulleys permanently installed on the tower to lift workers from the bottom of the tower to the top (and anywhere in between). The system can be installed on new towers prior to installation or retrofitted to existing towers.

While several possible examples are disclosed above, examples of the present disclosure are not so limited. For instance, while systems and methods for access to stealth cell towers has been disclosed, other systems or subsystems could be utilized in a similar manner without departing from the spirit of the disclosure. In addition, while generally referred to above as cell towers, the system can be used on many types of structures that are otherwise inaccessible (e.g., telephone poles, high tension power towers, etc.). Finally, the order of steps in many of the methods discussed herein could be changed without significantly affecting the functionality of the disclosure. Such changes are intended to be embraced within the scope of this disclosure.

The specific configurations, choice of materials, and the size and shape of various elements can be varied according to particular design specifications or constraints requiring a device, system, or method constructed according to the principles of this disclosure. Such changes are intended to be embraced within the scope of this disclosure. The presently disclosed examples, therefore, are considered in all respects to be illustrative and not restrictive. The scope of the disclosure is indicated by the appended claims, rather than the foregoing description, and all changes that come within the meaning and range of equivalents thereof are intended to be embraced therein.

The invention claimed is:

1. A system for scaling a cell tower comprising:

a cable with a length equal to at least twice a height of the tower;

a conduit disposed vertically on the tower to house the cable from proximate a bottom of the tower to proximate a top of the tower;

a first pulley disposed proximate the top of the tower to change a direction of the cable;

a winch disposed proximate the bottom of the tower attached to a first end of the cable to pull the cable in a first direction;

a counterweight disposed on a second end of the cable to pull the cable in a second direction;

a channel disposed vertically on an outside surface of the tower; and a basket slideably engageable with the channel and detachably coupleable to the first end of the cable to carry a worker from the bottom of the tower to the top of the tower;

wherein the winch moves the cable between a deployed position, in which the first end of the cable is proximate the bottom of the tower, and a retracted position, in which the first end of the cable is proximate the top of the tower; and wherein the channel is sized and shaped to maintain an alignment of the basket.

2. The system of claim 1, wherein the winch is mounted on the tower.

3. The system of claim 1, further comprising:

a second pulley disposed proximate the top of the tower to change a direction of the cable; and a third pulley disposed proximate the bottom of the tower to change a direction of the cable.

4. The system of claim 1, wherein the length of the cable is equal to three times the height of the tower to enable the cable to be inspected during use.

5. The system of claim 1, further comprising a retainer sized and shaped to retain the counterweight when the cable is in the retracted position.

6. The system of claim 1, further comprising:

a harness wearable by a worker and detachably coupleable to the first end of the cable to lift the worker from the bottom of the tower to the top of the tower.

7. The system of claim 1, wherein the channel comprises a C-channel;

wherein the basket comprises one or more rollers disposed on the basket; and wherein the one or more rollers are sized and shaped to ride inside the C-channel to maintain the alignment of the basket.

8. The system of claim 7, wherein the one or more rollers are outwardly spring-loaded to maintain tension between the one or more rollers and the inside of the C-channel.

9. The system of claim 1, wherein the channel comprises an I-beam;

wherein the basket comprises one or more rollers disposed on the basket; and wherein the one or more rollers are sized and shaped to ride outside the I-beam to maintain the alignment of the basket.

10. The system of claim 9, wherein the one or more rollers are inwardly spring-loaded to maintain tension between the one or more rollers and the outside of the I-beam.

11. The system of claim 1, wherein the channel comprises a C-channel;

wherein the basket comprises one or more shoes disposed on the basket; and wherein the one or more shoes are sized and shaped to ride inside the C-channel to maintain the alignment of the basket.

* * * * *